US006398455B1

(12) United States Patent
Vølstad

(10) Patent No.: US 6,398,455 B1
(45) Date of Patent: Jun. 4, 2002

(54) METHOD FOR STRATIFIED CONSTRUCTION AND HEATING A GRASS PITCH, PARTICULARLY A FOOTBALL GROUND, AND A GRASS PLAYING FIELD BUILT UP IN ACCORDANCE WITH THE METHOD

(75) Inventor: Ove C. Vølstad, Kvernaland (NO)

(73) Assignee: Vølstad Energy AS, Kvernaland (NO)

( * ) Notice: Subject to any disclaimer, the term of this patent is extended or adjusted under 35 U.S.C. 154(b) by 0 days.

(21) Appl. No.: 09/445,882

(22) PCT Filed: Jun. 4, 1998

(86) PCT No.: PCT/NO98/00163

§ 371 (c)(1),
(2), (4) Date: Mar. 2, 2000

(87) PCT Pub. No.: WO99/01619

PCT Pub. Date: Jan. 14, 1999

(30) Foreign Application Priority Data

Jul. 4, 1997 (NO) ..... 973111

(51) Int. Cl.[7] ..... E01C 13/02

(52) U.S. Cl. ..... 405/43; 405/45; 405/36; 472/92

(58) Field of Search ..... 405/36, 37, 38, 405/43, 44, 45, 52, 53; 472/92

(56) References Cited

U.S. PATENT DOCUMENTS

| | | | | | |
|---|---|---|---|---|---|
| 1,050,914 | A | * | 1/1913 | Branch | 472/92 |
| 3,908,385 | A | | 9/1975 | Daniel et al. | |
| 4,023,506 | A | * | 5/1977 | Robey | 405/43 |
| 4,268,993 | A | * | 5/1981 | Cunningham | 405/37 |
| 4,462,184 | A | * | 7/1984 | Cunningham | 405/37 |
| 4,832,526 | A | * | 5/1989 | Funkhouser, Jr. | 405/43 |
| 4,913,596 | A | * | 4/1990 | Lambert, III | 405/43 |
| 5,120,158 | A | | 6/1992 | Husu | |
| 5,163,781 | A | | 11/1992 | Husu | |
| 5,254,039 | A | * | 10/1993 | Garcia | 472/92 |
| 5,460,867 | A | | 10/1995 | Magnuson et al. | |
| 5,746,028 | A | * | 5/1998 | DiBenedetto | 472/92 |
| 5,752,784 | A | * | 5/1998 | Motz et al. | 405/37 |
| 5,944,444 | A | * | 8/1999 | Motz et al. | 405/37 |

* cited by examiner

*Primary Examiner*—David Bagnell
*Assistant Examiner*—Frederick L. Lagman
(74) *Attorney, Agent, or Firm*—Andrus, Sceales, Starke & Sawall, LLP

(57) ABSTRACT

A grass field such as a football playing ground comprises an underground heating and heat distributing plant below the uppermost growth layer (10). In order to provide a grass field built up, layer on layer, and heatable from below, as well as exhibiting a structure which will not be able to settle in the course of time, and wherein the pitch-corer substantially maintains its flat, plane, essentially horizontal original condition, the grass field is based on the use of air-carried heat energy, heated air being brought to distribute itself in a lower hot air distributing cavity layer covering the basal area of the pitch, and wherein some heat energy of the supplied air is liberated to wall faces (4, 5) defining said lower cavity layer, whereafter return air within an upper cavity layer assigned air communication holes (5') in a partition wall can be drawn off for reheating and reuse.

10 Claims, 1 Drawing Sheet

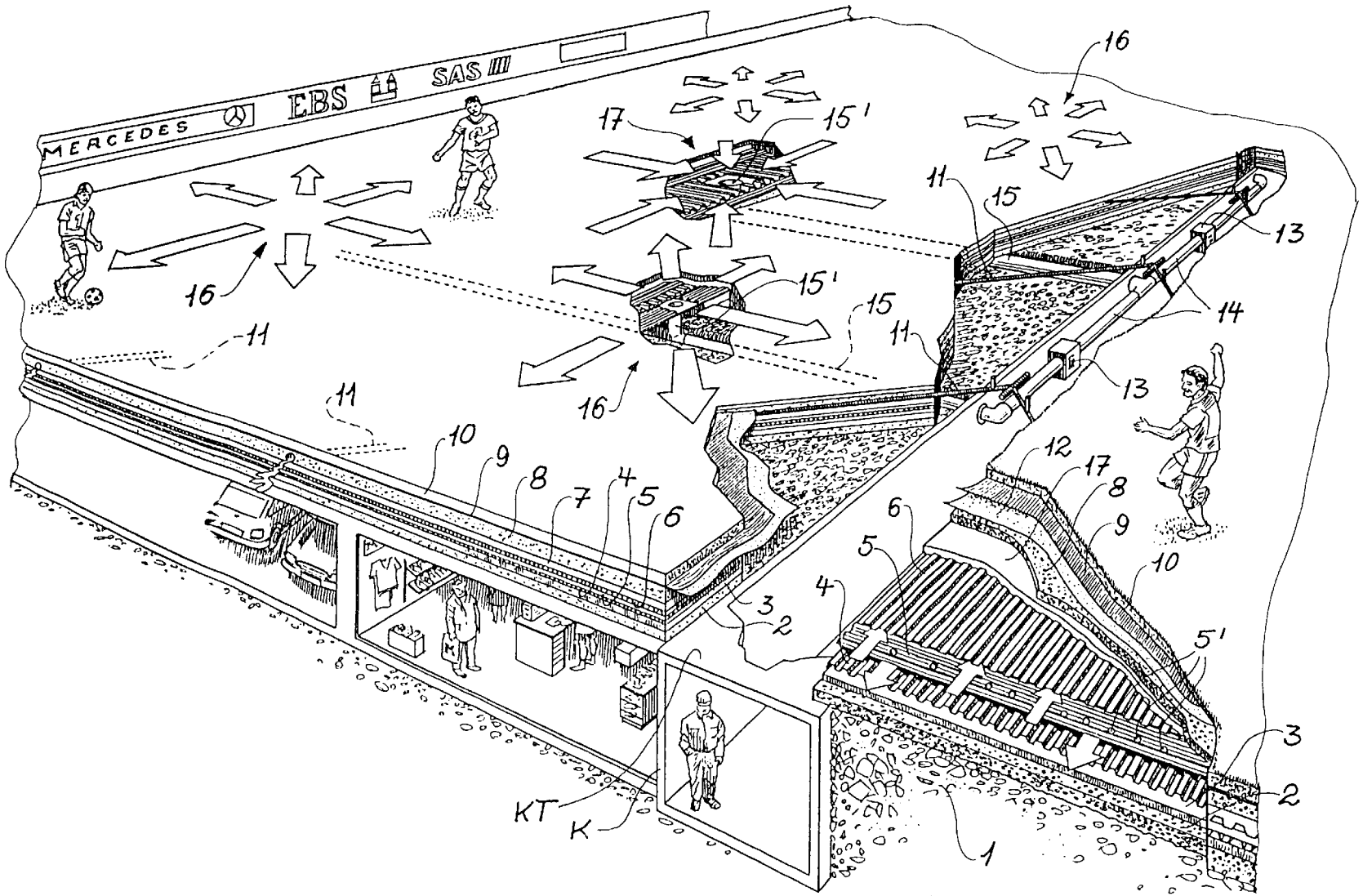
MERCEDES
EBS
SAS
KT
K

METHOD FOR STRATIFIED CONSTRUCTION AND HEATING A GRASS PITCH, PARTICULARLY A FOOTBALL GROUND, AND A GRASS PLAYING FIELD BUILT UP IN ACCORDANCE WITH THE METHOD

BACKGROUND OF THE INVENTION

This invention relates to a method for stratified construction of a grass pitch such as a football ground, comprising a pitch cover in the form of an uppermost positioned growth layer and underlying layers containing draining mass, equipped with a draining system, and assigned an underground, air-based heating plant supplied heat energy thereto through a gaseous energy carrier such as air. Likewise, the invention relates to heatable grass pitches built stratifiedly up in accordance with the method and assigned a buried, underground heating plant.

The compulsory football season in this country (Norway) does not expire before late fall, and international matches extend the season still further. The need for usable grass grounds in springtime before the season starts, is large and, in the month of March, only a few grass grounds are satisfactory, even in the Southern parts of the country.

There exist heatable football fields, mainly based on buried electrical cables. Other underground heating plants comprise pipe systems for flowing hot water.

Through the heating of a grass pitch, snow and ice are efficiently melted, and permanent use of heating cables/hot water pipes through the winter season, frost may be kept away from the pitch area, so that frost heaving and the influence of the frost on the grass roots are avoided, especially in early spring months with hot days and cold nights. Underground heating systems could, possibly, be supplemented by covering tarpaulin in periods with heavy snow fall.

In connection with buried electrical cable systems for foot ball fields, etc., it presents a disadvantage that large amounts of superior energy are used. This alternative appears as particularly energy-requiring and unprofitable.

Using water-carried heat, one has certainly a larger energy flexibility. However, there exist risks for leakages and broken water pipes, complicating operation and maintenance.

Electrical heating cables as well as water pipes included in underground heating plants are relatively simple to lay and mount but, in the course of time, they will usually change positions, especially vertically, dependent on the nature of those masses in which they were laid and to what kind of treatment/load the surface layer/layers have been subjected at any time.

In heating cable plants as well as in water pipe plants, one has systematically avoided to use insulation layers beneath the heating cables/water pipes above the ground; the underlying layers of the field body being heated to no purpose.

Nor, known technique has been capable of securing even, stable surfaces of grass fields in the course of time.

SUMMARY OF THE INVENTION

The object of the invention has, therefore, been to overcome or reduce disadvantages of known technique and, thus, provide partly a rational method for building up and heating grass fields, partly a heatable grass field built up in accordance with the method and not exhibiting disadvantages, deficiencies or limitations of use and application, in or relating to known grass fields or to the buried heating plants thereof.

The object is realized through proceeding in accordance with the first method claim, respectively by means of a grass ground built stratifiedly up and assigned a buried heating plant based on air as heat energy carrier. Moreover, the grass pitch may be assigned a draining plant known per se and which, according to a special feature of the invention, may be utilized as an underground watering plant.

Use of air as heat energy carrier means versatile energy flexibility in respect of heating source/type. Solar energy, remote heat, heating pump, electricity, oil, gas, biofuel, wind force, etc. may be used.

Above a horizontal bottom layer, a draining mass layer is laid and rounded off absolutely accurately in respect of slope, preferably by means of laser technique, whereafter insulation is laid in the form of water-repellent material practically insensitive to influence from the immediately adjacent layers. The insulation may consist of relatively rigid, shape-durable plate units joined together to form large flake-like coverings or coats.

Above the insulations which has the task of preventing energy in supplied heated air to escape in a direction downwardly into the ground, follow two horizontal parallel cavities which, except from fluid communication along the outer edges of the pitch, are separated from each other and serve as air-conveying cavities. The simplest way of forming the cavities is between parallel, horizontal plates, spacers being placed in the cavities.

According to the preferred embodiments of the invention, the three parallel, horizontal plates are formed as corrugated plates of e.g. steel, which gives a strong structure in which the "spacers" are built into the plate design. The intermediate corrugated plate layer is provided with a number of vertical, through-going holes which, preferably, are distributed along the outer edges and constitute fluid communication between the lower and upper cavities. Heated air blown into the cavity formed by the two lowermost corrugated plate layers disperses itself across the respective cavity's area (corresponding to the area of the grass pitch), in order to, through said through-going holes in the central corrugated plate layer, to flow up into the upper cavity, from where the air can be sucked out of the upper cavity for, thereafter, to be heated up once more within a suitable heating device.

Dependent on the size and extent of the grass pitch in width and length, several such circuits for air as energy carrier may be disposed.

The three corrugated plate layers are placed such in relation to each other that lower and upper layer's rectilinear crests of the waves extend mutually parallel, while the intermediate corrugated plate layer's crest of waves cross the crests of waves of the two adjacent layers perpendicularly.

Above the uppermost corrugated plate layer, a concrete layer has been cast and in which expansion joints are inserted with appropriate spacings and equidistantly distributed across the area of the entire grass pitch. The concrete layer is load-bearing and secures a non-changeable, horizontal support layer.

The work with the building of the pitch is continued on top of the concrete layer through the positioning of an in per se known draining pipe system which, in accordance with the invention, is disposed such that it, besides its well known draining function, may carry out watering and venting from within the upper layer of the pitch-bed, Around the draining pipes, a so-called "gardener's felt" can be disposed, the felt being temporarily coiled together so that adjacent draining masses ay be packed well together within the chosen layer thickness. Thereafter, gardener's felt is stretched out upon the top of the draining masses. Immediately on top of the gardener's felt, a so-called building cloth may be placed before the uppermost layer, the growth layer, is positioned. The air-conducting pipes of the heating plant are laid during the building of the grass pitch and secure that heated air becomes conducted into the lowermost cavity at a larger number of air supply spaces distributed across the area of the entire pitch, where an upright, upwardly open branch pipe supplies heated air forcedly (by means of a fan) to the lower cavity which is filled with this heated air within its entire volume, so that the pitch is heated across its entire area, until the air blown in, in a cooler condition, reaches the edge perforations in the intermediate corrugated plate and, through these, ends in the upper cavity where only a suction out of the air takes place, in order to, thereafter, heat it up again by means of a heating aggregate which can be disposed within a covered culvert which, e.g., extends through the entire pitch body.

BRIEF DESCRIPTION OF THE DRAWING/ DETAILED DESCRIPTION OF THE INVENTION

The invention is further explained in the following, reference being made to the following drawing showing a perspective general view in which a grass pitch is cut vertically at several places.

In the partial perspective view, reference numeral 1 denotes existing untouched ground, respectively where original mass has been substituted by more appropriate mass.

Prior to the work by which the football field is built up from below and upwardly of a plurality of layers included in the pitch body/the heating plant therefore, it may, according to the invention, be suitable to build an elongate culvert K extending in the longitudinal direction of the resultant football field, and the upper, outer roof surface KT of the culvert may be positioned at substantially the same level as the upper surface of the mass layer 1.

Immediately above the mass layer 1, respectively the culvert roof RT, a draining layer 2 follows, which is rounded off quite accurately in respect of the desired slope. Thereafter, an insulation layer 3 is laid.

On top of the insulation layer 3 follows the heat energy distributing system of the plant which, in accordance with the present embodyment form, comprises two substantially horizontal cavity layers which, apart from a larger number of holes 5' in a corrugated plate layer 5 along the outer edges of the pitch body, are separated from each other, causing heated air supplied thereto to be distributed approximately regularly across the area of the total pitch in the lower cavity layer, heating up adjacent mass, material, etc., before the heating air, in a somewhat cooler condition, leaves the lower cavity layer and, through the holes 5', flows up into the upper cavity layer of the heating device, from where the cooler, gaseous energy carrier is sucked out, preferably, for reheating and utilization of the rest heat thereof.

In order to fill the lower cavity layer with heated air, respectively for sucking "used", cooler air from the upper cavity layer, a plurality at air suction and air discharge devices are disposed equidistantly across the field area.

The two parallel cavity layers which, apart from local fluid communication through the vertically through-going air transferring holes 5' along the outer edges of the pitch, shall be separated from each other for the purpose of distributing supplied heated air across, preferably, the whole area or a lower cavity layer, are formed by means of three corrugated plate layers 4, 5 and 6, of Which the lowermost and uppermost corrugated plate layer 4 and 6 with their rectilinear crests of waves can extend in the longitudinal direction of the resulting grass field, while the intermediate corrugated plate layer 5 with the holes 5' is orientated perpendicularly to the rectilinear crests of waves of the remaining corrugated plate layers 4, 6. Construction of the underground, air-based heating plant by means of corrugated plates of steel which are joined together to form large flake-like layers results, upon the choice of a moderate plate thickness dimension, in a very strong and load resistant structure.

Then, on top of the corrugated plate assembly 4–6, a concrete layer 7 is cast, constituting a permanent, horizontal support layer securing the evenness of overlying layers 8–10, of which 8 denotes a draining mass layer, 9 a so-called building cloth and 10 the growing or cultivation layer (turf layer).

The work is continued, laying combined pipes 11 for draining purposes, as conventionally well known, but, according to the invention, these draining pipes 11 are multifunctional pipes and can be used for venting or watering, respectively (internally within the pitch-body), as this draining pipe system in the first case is coupled to an air injection aggregate or several such aggregates respectively, in the latter case is coupled to water supply aggregates for internal watering of the pitch body. Around the multifunctional pipes 11, a gardener's felt 12 is disposed, as previously explained.

In the culvert K, one or more aggregates 13 for generating/heating hot air are built in, said hot air being passed into a longitudinal pipe 14 exhibiting lateral branch pipes 15 which, regularly distributed across the field area, have upright, angled, upwardly open pipe pieces 15' assigned blow out places 16 for supply air, respectively exhaust places 17 for suction of return air.

In operation, a grass field built up in accordance with the invention functions such in combination with the air-based heating system 4,5,6,13,14,15,16,17 that heated gaseous energy-carrier from the aggregate 13 through the pipes 14, 15, 15' ends in the lowermost cavity layer and distributes itself within the same before the air subsequently to heat loss leaves the lower cavity layer through the edge holes 5' of the intermediate corrugated plate layer 5 and lands in an uppermost cavity layer, in which prevails a vacuum or suction effect, established by means of an air transport fan (not shown) which may be included in the aggregate 13. Used air is sucked from the uppermost cavity layer through the exhaust place 17, and this, somewhat cooled air is utilized in respect of its possible rest heat and is, therefore, heated again within the aggregate 13.

The uppermost corrugated plate 6 is in contact with the concrete layer 7 and, heat transferringly, also with the remaining overlying layers, the draining masse layer 8 and the uppermost growing or cultivation layer 10 with the intermediate building cloth 9. The difference between the temperature of the energy-containing air in contact with the uppermost corrugated plate 6 and the temperature of overlying layers causes a temperature equalizing effect to take place, drawing off heat energy from the energy-containing air. Through the circulation of the beat energy carrying air within a closed system, in which new heat energy is continuously supplied from the aggregate 13, an efficient heat exchange is achieved at a minimum of energy consumption. If desired, cold air may, of course, be supplied through the aggregate 13.

The pipes 11 of the combined pipe system for draining, venting and internal watering is, from a longitudinal centre line, placed in a herring bone pattern. The pipes 11 are ordinarily available draining pipes which, however, have been laid slopingly of the order 1:200 out towards the goal lines; slopes of approximately 1:100 being usual in ordinary football grounds. In accordance with the invention, the draining/venting/watering pipes 11 are laid immediately on top of the concrete layer 7. When draining takes place at such a level and with such a support, the establishment of a flat, practically plane pitch cover 10 is made possible, only varying the height of the draining mass layer 8. A flat, practically level pitch cover 10 represents considerable advantages in relation to conventional pitch covers of football grounds in which the slope to opposite sides is substantial from the centre of the pitch.

The positioning of the building cloth 9 and the gardener's felt 12 is advantageous. Subsequently to a considerable rain weather, a so-called cloudburst, this cloth 9 and this felt 12 will be completely soaked and represent an advantageous reserve water source at the right place for optimal growth-favouring for the grass plants in periods with less rain.

Upon the utilization of the draining pipe system 11 underground watering system, one may, periodically, use water, possibly liquid manure, which is pumped into the pipe system 11 in a way not closer shown. The draining pipe system 11 is everywhere provided with intermediate, partially open slots or through-going perforations, respectively, and some of the, possibly manured, watering water supplied thereto has, thus, the possibility of seeping out through the openings to the dry, moisture-absorbing gardener's felt 12 which, thus, acts as a wick, transferring water to the overlying building cloth 9. This water transfer from the draining pipe system 11 to the building cloth 9 immediately beneath the growth/cultivating layer 10 causes an even water distribution across the entire pitch area. The result is an efficient watering of the grass roots from below.

Large football grounds surrounded by tall stands at all sides do not secure a natural ventilation of the grass field. In order to vent the "grass carpet" from below, the draining pipe system can be coupled to an air compressor or pumping device which provides injection of air in order to vent the pitch cover. Air escapes little by little through the perforations of the pipe system 11, flowing out into the mass layer 8, from there through the gardener's felt layer 12 and the building cloth 9, before it flows up through the growth layer 10 and out into the free atmosphere. On its way up through the growth layer 10, free oxygen is supplied to the root system of the grass plants. Venting of the growth layer 10 may well take place simultaneously with watering by means of the draining pipe system. In such a case, an overpressure in the pipes 11 arising in connection with venting causes the displacement of watering water efficiently out from the pipes 11, so that it first comes into contact with the gardener's felt 12, thereafter with the "working cloth" 9 and then with the grass roots in the growth layer 10 such as previously described.

What is claimed is:

1. A method for stratified construction of a grass pitch of the football ground type, the grass pitch having a plurality of horizontal layers and being suitable for being heated by a heating plant by which heat energy is supplied to a gas, said method comprising the steps of:

forming a first underlying layer (2);

laying an insulating layer over the first underlying layer (2);

forming at least two substantially horizontal, adjacent but essentially separated, cavity layers (4,6) extending across substantially the area of the grass pitch above the insulating layer, a lower cavity (4) being suitable for receiving heated gas from the heating plant, an upper cavity (6) removing gas;

casting a layer (7) of load-carrying castable material on an upper surface of the upper cavity layer;

placing a second underlying layer (8) on the cast layer, the first and second underlying layers forming a draining mass for the grass pitch;

placing a draining pipe system (11) in the second underlying layer (8); and positioning an uppermost grass growing layer (10) above the second underlying layer (8).

2. A method as defined in claim 1, characterized in that, above the draining pipe system (11), farther, moistenable absorption layers (8, 9) are laid, said absorption layers forming a reserve water source for the grass growing layer (10) in dry periods.

3. A method as defined in claim 1, characterized in that the draining pipe system (11) is suitable for being coupled to at least one of a water supply device and an air injecting device, in order to convert the pipe system (11) to at least one of a watering and venting system.

4. A method as defined in claim 1, characterized in that an intermediate partition wall layer (5) is placed between the cavity layers (4, 6) such that vertically through-going holes (5') become positioned at or adjacent one or more outer edges of the grass pitch which is in the course of being built up.

5. A method as defined in claim 4, characterized in that the two said cavity layers (4, 6) extending substantially across the area of the grass pitch and being in fluid communication with each other through said holes (5') in the partition wall layer (5), said holes (5'), preferably, being positioned along at least one outer edge of the pitch, and wherein the lower cavity layer (4) is defined between a lower corrugated plate layer having the rectilinear crests of waves extending in a first direction, and said partition wall layer (5) which, likewise, constitutes a corrugated plate layer having rectilinear crests of waves extending in a second direction perpendicularly to said first direction, and that the upper cavity layer (6) is defined by the partition wall layer (5) and an upper corrugated plate layer (6), of which the straight crests of waves extend parallel to the straight crests of waves of the lower corrugated plate layer (4).

6. A grass pitch of the football ground type, the grass pitch having a plurality of horizontal layers and being suitable for being heated by a heating plant by which heat energy is supplied to a gas, said grass pitch comprising:

a first underlying layer (2);

an insulating layer over the first underlying layer (2);

two substantially horizontal, adjacent but essentially separated cavity layers (4,6) extending across substantially the area of the grass pitch above said insulating layer, a lower cavity (4) being suitable for receiving heated gas from the heating plant, an upper cavity (6) removing gas, said cavity layers being formed of a corrugated upper plate (4) and a corrugated lower plate (6) separated by an intermediate corrugated plate (5);

a layer (7) of load-carrying castable material on an upper surface of the upper plate;

a second underlying layer (8) on the cast layer, the first and second underlying layers forming a draining mass for the grass pitch;

a draining pipe system (11) in the second underlying layer (8) suitable for connection to one of a water supply device and an air injection device; and an uppermost grass growing layer (10) above the second underlying layer (8).

7. A grass pitch as defined in claim 6 further including moisture absorbing/liberating materials (9, 12) immediately below said grass growing layer.

8. A grass pitch as defined in claim 7 wherein said moisture absorbing/liberating material includes at least one of gardener's felt and building cloth.

9. A grass pitch as defined in claim 6 wherein said intermediate corrugated plate (5) has vertically through-going holes (5') positioned at or adjacent one or more outer edges of the grass pitch.

10. A grass pitch as defined in claim 6 wherein said upper and lower corrugated plates have rectilinear crests of waves extending in a first direction and wherein said intermediate corrugated plate (5) has rectilinear crests of waves extending in a second direction perpendicular to said first direction.

* * * * *